US009548559B2

(12) United States Patent
Zhou et al.

(10) Patent No.: US 9,548,559 B2
(45) Date of Patent: Jan. 17, 2017

(54) METHOD OF RETAINING MAGNETS TO INSULATIVE HOUSING OF CONNECTOR

(71) Applicant: FOXCONN INTERCONNECT TECHNOLOGY LIMITED, Grand Cayman (KY)

(72) Inventors: Zhi-Yong Zhou, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/081,965

(22) Filed: Mar. 28, 2016

(65) Prior Publication Data

US 2016/0285198 A1 Sep. 29, 2016

(30) Foreign Application Priority Data

Mar. 27, 2015 (CN) ..... 2015 1 0138662

(51) Int. Cl.

| | |
|---|---|
| ***H01R 11/30*** | (2006.01) |
| ***H01R 13/62*** | (2006.01) |
| ***H01R 13/24*** | (2006.01) |
| ***H01R 43/20*** | (2006.01) |
| ***H01R 13/504*** | (2006.01) |

(52) U.S. Cl.

CPC ..... *H01R 13/6205* (2013.01); *H01R 13/2442* (2013.01); *H01R 13/504* (2013.01); *H01R 43/20* (2013.01); *H01R 11/30* (2013.01)

(58) Field of Classification Search

None

See application file for complete search history.

(56) References Cited

U.S. PATENT DOCUMENTS

| | | | | |
|---|---|---|---|---|
| 9,413,087 | B2 * | 8/2016 | Shariff | H01R 11/30 |
| 2010/0197148 | A1 * | 8/2010 | Rudisill | H01R 11/30 439/40 |
| 2013/0210244 | A1 | 8/2013 | DiFonzo et al. | |
| 2015/0325949 | A1 * | 11/2015 | Wei | H01R 13/6205 439/39 |
| 2015/0349457 | A1 | 12/2015 | Shariff et al. | |

* cited by examiner

*Primary Examiner* — Tho D Ta

(74) *Attorney, Agent, or Firm* — Wei Te Chung; Ming Chieh Chang

(57) ABSTRACT

A connector assembly has an insulative housing including a top wall, a bottom wall, a side wall, and a receiving cavity enclosed by these walls. A slot and some passageways are formed on the top wall and communicating to the receiving cavity along a vertical direction. A printed circuit board is received within the receiving cavity. A plurality of contacts connected to the printed circuit board have moveable contacting portions extending through the corresponding passageways and upwardly beyond a top face of the top wall. A magnet includes a top section received within the slot and a bottom section bonded to the bottom wall through melting a part of the bottom wall.

16 Claims, 6 Drawing Sheets

METHOD OF RETAINING MAGNETS TO INSULATIVE HOUSING OF CONNECTOR

BACKGROUND OF THE INVENTION

1. Field of the Invention

The present invention relates to a connector assembly, and more particularly to a connector assembly having an insulative housing and a magnet retained therein.

2. Description of Related Arts

Portable devices are often powered by rechargeable batteries. Some portable devices, such as a wearable device, notebook, tablet, mobile phone, etc., have a female connector with a magnetic element mounted therein. A male connector assembly with a cable has a housing, a plurality of moveable contacts extending out of the housing, and a magnet installed within the housing. The magnet of the male connector assembly could be attracted by the magnetic element of the female connector to guide the male connector assembly to mate the female connector and maintain the connection. The magnet is usually bonded to the housing by applying liquid glues.

U.S. Patent Application Publication No. 2015/0349457 discloses a data and power connector having a top housing half, a bottom housing half, and a pair of magnets received within the bottom housing half. The bottom housing half has a plurality of ribs formed on a bottom wall thereof. The magnets are mounted upon the ribs. Each magnet has a shoulder structure on its top section. Rib or bar like structures are also formed on peripheral rims of the top and bottom housing halves for retaining purpose, e.g., bonding or hot melting.

A connector assembly with stable magnet is desired.

SUMMARY OF THE INVENTION

Accordingly, an object of the present invention is to provide a method for making a connector assembly, comprising the following steps:

(1) providing an upper case, a printed circuit board assembly (PCBA) with a set of contacts, and a magnet, the upper case including a top wall, four peripheral walls extending upwardly, and a top receiving cavity surrounded therebetween, the top wall including a slot and a plurality of passageways extending therethrough along a vertical direction;

(2) assembling the PCBA and the magnet into the upper receiving as a top assembly;

(3) providing a lower case having a bottom wall, four peripheral walls extending upwardly, and a bottom receiving cavity surrounded therebetween;

(4) assembling the top assembly to the lower case with the contacts going through the corresponding passageways and the magnet having a top section mounted into the slot and a bottom section abutting against the lower wall of the bottom case;

(5) heating the top section of the magnet through the slot and bonding the bottom section of the magnet to the lower case through hot melting a part of the bottom wall of the bottom case.

Another object of the present invention is to provide a connector assembly having an insulative housing including a top wall, a bottom wall, a side wall, and a receiving cavity enclosed by these walls. A slot and some passageways are formed on the top wall and communicating to the receiving cavity along a vertical direction. A printed circuit board (PCB) is received within the receiving cavity. A plurality of contacts connected to the PCB have moveable contacting portions extending through the corresponding passageways and upwardly beyond a top face of the top wall. A magnet includes a top section received within the slot and a bottom section bonded to the bottom wall through melting a part of the bottom wall. Notably, the coupling between the magnet and the insulative housing through hot melting is more stable than the coupling between the magnet and the insulative housing through liquid glue.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to some preferred embodiments of the present invention.

Figure 1:
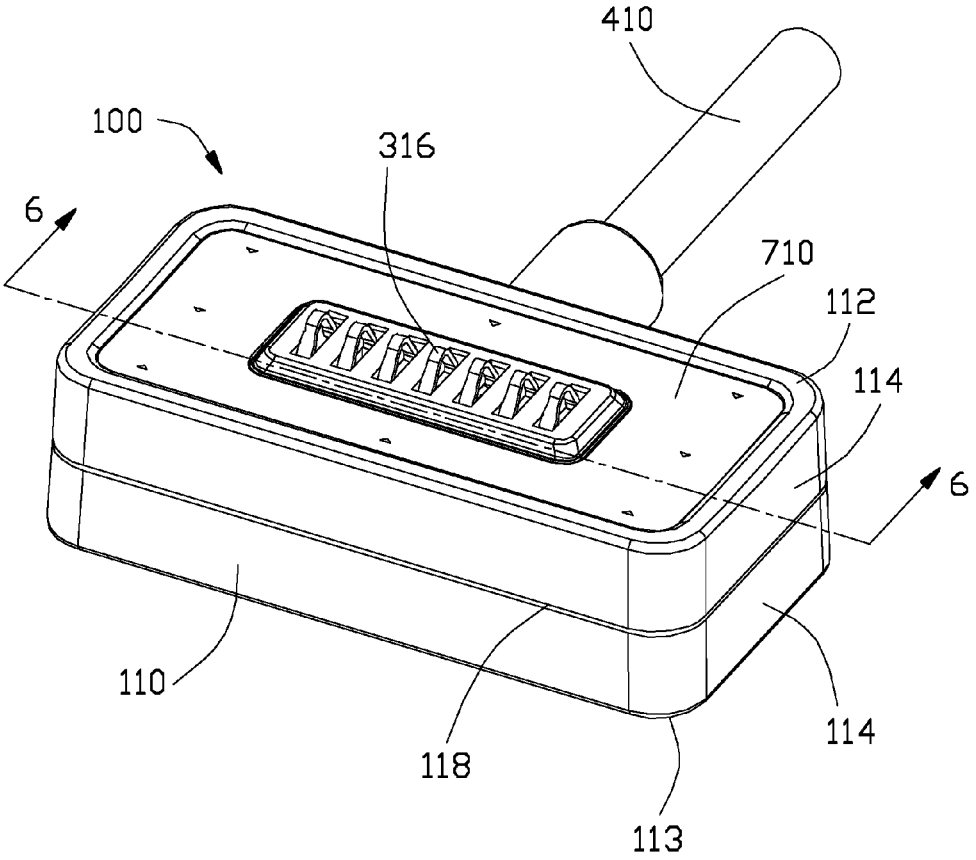
FIG. 1 is a front perspective view of a connector assembly in accordance with the present invention.
Figure 2:
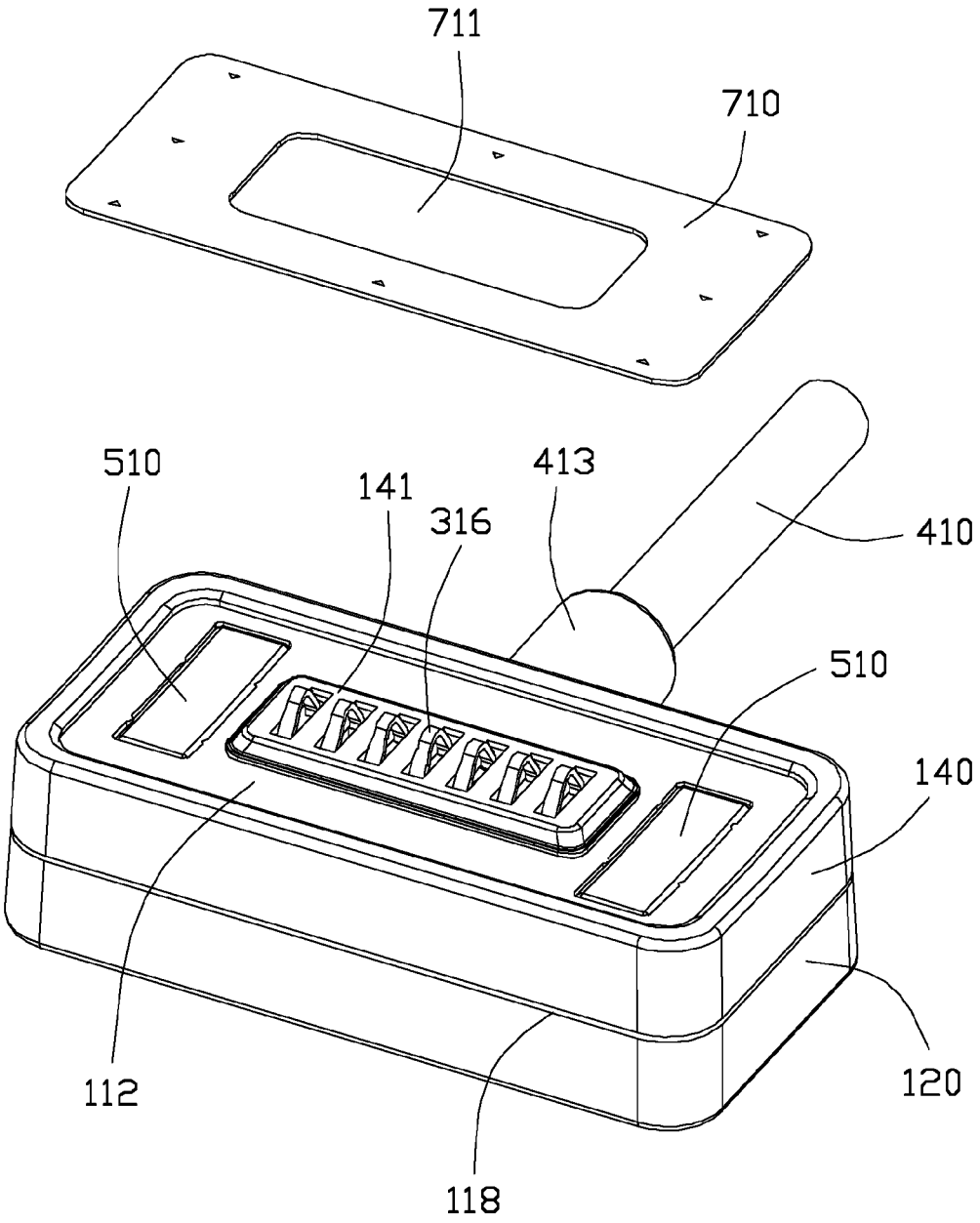
FIG. 2 is a front exploded view of the connector assembly as shown in FIG. 1.
Figure 3:
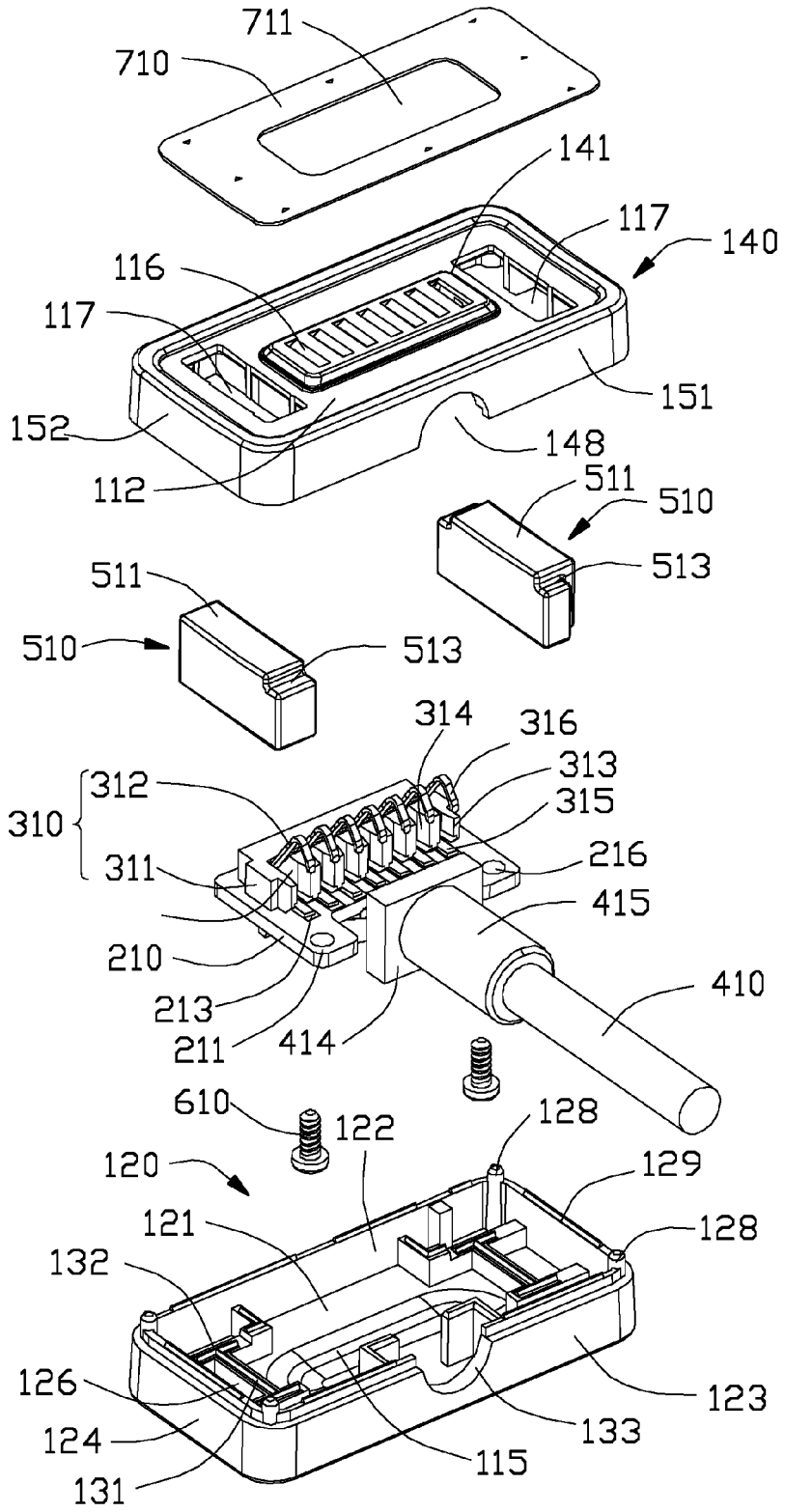
FIG. 3 is a rear exploded view of the connector assembly as shown in FIG. 1.
Figure 4:
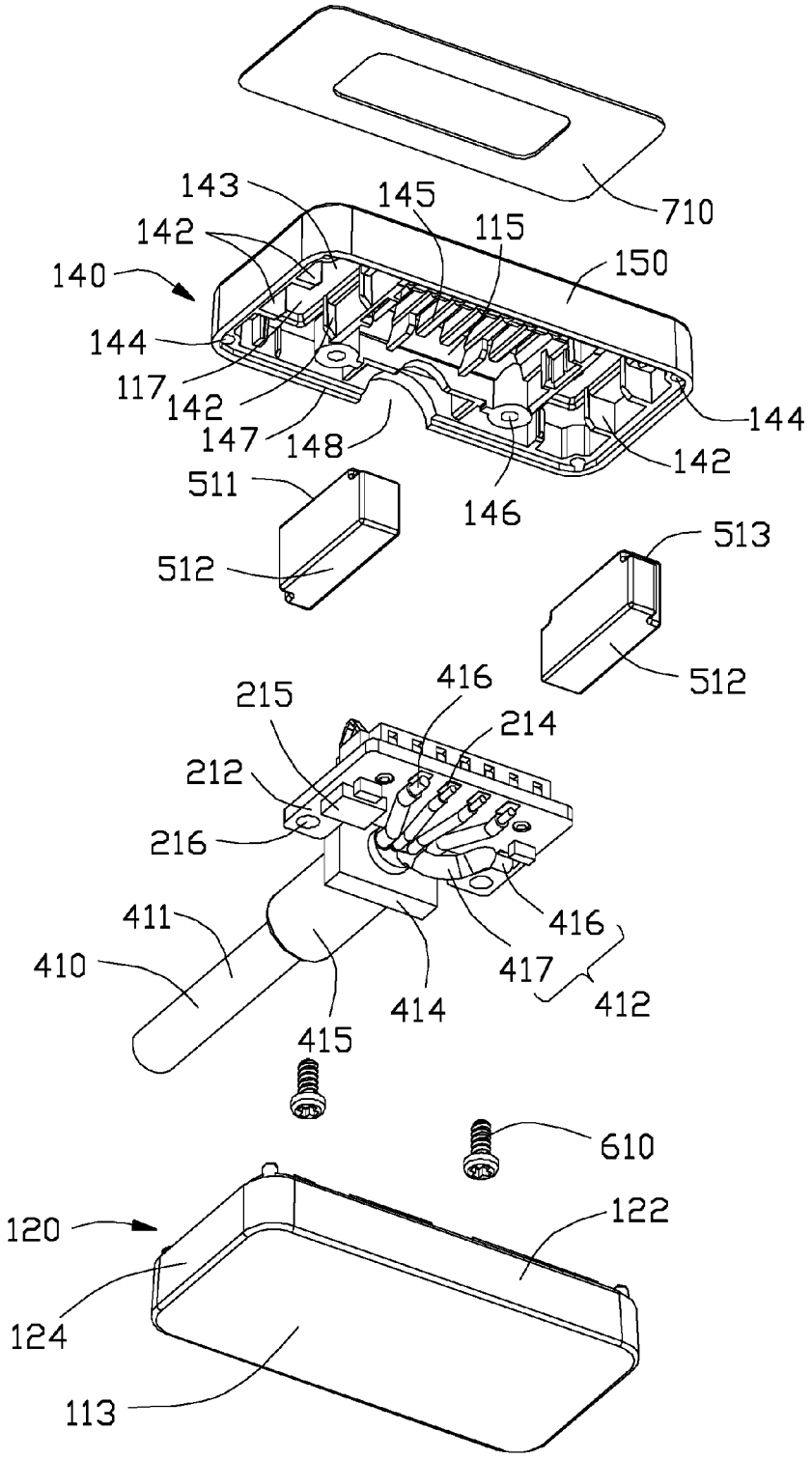
FIG. 4 is bottom exploded view of the connector assembly as shown in FIG. 2.
Figure 5:
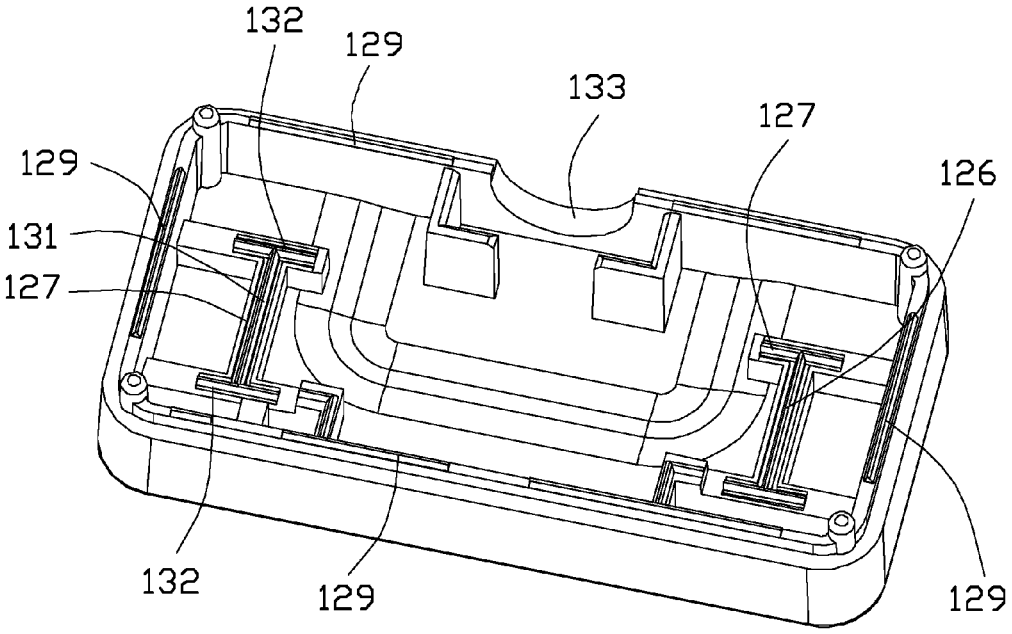
FIG. 5 is a front view of the lower case as shown in FIG. 2.
Figure 6:
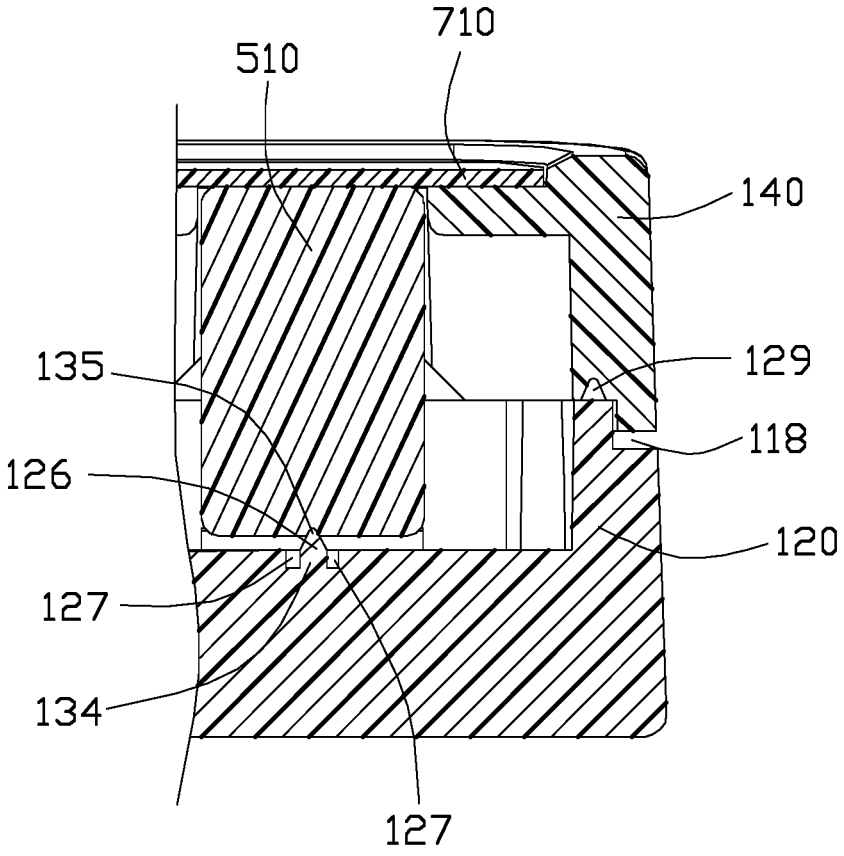
FIG. 6 is a cross-sectional view of the connector assembly as seen in FIG. 1, taken along line 6-6.

Referring to FIGS. 1 to 6, a connector assembly 100 includes an insulative housing 110 having a top wall 112, a bottom wall 113, a side wall 114 disposed therebetween, and a receiving cavity 115 surrounded by the walls.

A row of passageways 116 are formed on the top wall 112 and communicating to the receiving cavity 115 along a vertical direction. The passageways 116 are disposed in a side-by-side manner along a transverse direction perpendicular to the vertical direction. A pair of slots 117 are disposed at two opposing lateral sides of the passageways 116, respectively. Each slot 117 extends through the top wall 112 along the vertical direction and communicates to the receiving cavity 115. The passageways 116 and the slots 117 are disposed in a side-by-side manner.

A seam 118 bisects the insulative housing 110 along the vertical direction, and the insulative housing 110 includes a lower case 120 and an upper case 140 jointed integrally through hot melting. The upper case 140 has the top wall 112, a front wall 150, a rear wall 151, two side walls 152, and a half top receiving cavity 115 surrounded by these wall and opening downwardly. A stage 141 located between the slots 117 protrude upwardly from an upper surface of the top wall 112. The passageways 116 extend through the stage 141 along the vertical direction. A plurality of guiding protrusions 142 located around the corresponding slots 117 extend downwardly from an inner surface of the top wall 112. A mounting room 143 is defined by the guiding protrusions 142 and communicated to the corresponding slots 117 along the vertical direction. Four positioning holes 144 located at four corners of the upper case 140 extend downwardly therethrough. The upper case 140 has a row of spaced strips 145 protruding downwardly from the inner surface of the top wall 112 and extending along a front-to-back direction perpendicular to the vertical direction and the traverse direction. Each passageway 116 is located between two neighbored strips 145 along the transverse direction. Two mounting holes 146 are disposed around the rear wall 147 of the top case 140. The rear wall 146 forms a half hole 148 extending there through along the front-to-back direction.

The lower case 120 has the bottom wall 113, a front wall 122, a rear wall 123, two side walls 124, and a bottom half receiving cavity 115 opening upwardly. The bottom wall 121 includes a rib 126 protruding upwardly from an inner surface thereof before a magnet 510 is bonded to the bottom wall 121. The rib 126 is melted to bond the magnet 510 and the bottom wall 121, when the magnet is bonding to the bottom wall through an ultrasonic hot melting process. Two slits 127 are formed along two lateral sides of the rib 126 to receive a part of the melted rib 126, respectively. The rib 126 includes a strip portion 134 and a triangular pyramid portion 135 extending upwardly therefrom. The triangular pyramid portion 135 is melted to bond the magnet 510 and the bottom wall 121. Four positioning posts 128 inserted into the corresponding positioning holes 144 are located at four corners of the lower case 120. Each positioning post 128 has a top face located above the side walls 124. Each side wall 124 has a bar 129 protruding upwardly therefrom before the upper case 140 bonded to the lower case 120. The upper case 140 and the lower case 120 are jointed integrally by melting the bar 129 with an ultrasonic hot melting process. The rib 126 has a first section 131 extending along the front-to-back direction, and two second sections 132 disposed at two opposing sides of the first section 131 and extending along the transverse direction. The rear wall 123 forms a half hole 133 incorporated with the half hole 148 of the upper case 140 to define a circle hole.

A printed circuit board (PCB) 210 received in the receiving cavity 115 has a top face 211 and a bottom face 212 opposite to the top face 211. The PCB 210 includes a row of conductive pads 213 disposed on the top face 211, a row of conductive pas 214 exposed on the bottom face 212, and a plurality of electrical components 215 mounted thereon. The PCB 210 forms two circle holes 216 extending therethrough along the vertical direction and located at a rear region of the PCB 210.

A contact module 310 partly received within the receiving cavity 115 has a retainer 311 and a row of contacts 312 retained thereto. The retainer 311 received in the receiving cavity 115 has a row of spaced ribs 313 protruding backwardly and a plurality of retaining hole 314 each defined by two neighboring ribs 313. Each contact 312 has a mounting portion 315 soldered to the corresponding conductive pad 213 of the top face 211, a moveable contacting portion 316 extending through the corresponding passageway 116 and upwardly beyond a top face of the top wall 112, and a middle portion received within respective retaining hole 314. The contacting portion 316 of the contact 312 is deformed producing a triangular peak that is biased to protrude to the top wall 112 and is moveable toward the top wall 112 responsive to a force applied to the triangular peak.

A cable 410 includes an insulative sleeve 411, a plurality of electrical wires 412 received therein, and a strain relief 413. The strain relief 413 located at a front side of the cable 410 has a large dimension portion 414 received into the receiving cavity 115 and a small dimension portion 415 located out of the insulative housing 110. Each wire 412 includes a conductor 416 and an insulative sheath 417 enclosing therein. The front portions of the wires 412 extend out of the strain relief 413 to solder on the corresponding conductive pad 214 of the bottom face 212.

A pair of magnets 510 are disposed at two lateral sides of the PCB 210 along the transverse direction. The magnets 510 are installed to the mounting room 143 along the guiding protrusions 142. The magnets 510 are retained to the guiding protrusions 142 in an interference-ft manner. Each magnet 510 has a top section 511 inserted in the slot 117 and a bottom section 512 bonded to the bottom wall 121 through melting a part of the bottom wall 121. The magnet 510 forms two shoulders 513 abutting against the inner face of the top wall 112 and located at two sides of the top portion 511 along the front-to-back direction.

A pair of screws 610 are inserted through the circle holes 216 and screwed into the mounting holes 146 to retain the PCB 210 to the upper case 140.

A film 710 adhered to an upper surface of the top wall 112 has a central hole 711 extending therethrough along the vertical direction to receive the stage 141 therein. The stage 141 protrudes upwardly beyond the film 710. The magnets 510 located below the film 710 are shielded from exterior along the vertical direction.

The recapitulative step of assembling the plug connector assembly 100 includes following steps: (1) soldering the contact module 310 and the cable 410 to the PCB 210 to form a printed circuit board assembly (PCBA); (2) mounting the PCBA and the magnets 510 into the top half receiving cavity 115 of the top case 140 as a top assembly; (3) assembling the top assembly to the lower case 120 with the contacts 312 going through the corresponding passageways 116 and the top sections 511 mounted into the slot 117 and a bottom sections 512 abutting against bottom wall 121 of the lower case 120; (4) heating the top sections 511 of the magnets 510 through the slot 117 and bonding the bottom end 512 of the magnet 510 to the lower case 120 through hot melting a part of the lower wall of the bottom case; (5) bonding the upper case 140 to the lower case 120 through hot melting one part of the upper and lower cases; (6) assembling the film 710 to the top wall 112 of the upper case 140. The hot melting process is an ultrasonic hot melting process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for making a connector assembly, comprising the steps of:

providing an upper case, a printed circuit board assembly (PCBA) with a set of contacts, and a magnet, the upper case including a top wall, four peripheral walls extending upwardly, and a top receiving cavity surrounded thereby, the top wall including a slot and a plurality of passageways extending therethrough along a vertical direction;

assembling the PCBA and the magnet into the top receiving cavity to form a top assembly;

providing a lower case having a bottom wall, four peripheral walls extending upwardly, and a bottom receiving cavity surrounded thereby;

assembling the top assembly to the lower case with the contacts going through the corresponding passageways and the magnet having a top section mounted into the slot and a bottom section abutting against the lower wall of the bottom case; and heating the top section of the magnet through the slot and bonding the bottom section of the magnet to the lower case by hot melting a part of the bottom wall of the bottom case;

wherein the bottom wall has a rib protruding upwardly from an inner face thereof before the magnet is bonded to the bottom wall, the rib being melted to bond the magnet and the bottom wall when the magnet is bonded to the bottom wall;

wherein the bottom wall forms two slits along two lateral sides of the rib to receive a part of the melted rib.

2. The method for making a connector assembly as claimed in claim 1, further comprising a step of bonding the upper case to the lower case through hot melting one part of the upper and lower cases.

3. The method for making a connector assembly as claimed in claim 1, wherein the hot melting comprises an ultrasonic hot melting process.

4. The method for making a connector assembly as claimed in claim 1, wherein the PCBA includes a printed circuit board (PCB) connected with the contacts and a cable electrically connected to the contacts by the PCB.

5. A connector assembly comprising:

an insulative housing including a top wall, a bottom wall, a side wall, and a receiving cavity enclosed by the top, bottom, and side walls;

a plurality of passageways formed on the top wall and communicating with the receiving cavity along a vertical direction;

a slot extending through the top wall along the vertical direction and spaced from the passageways along a transverse direction perpendicular to the vertical direction;

a printed circuit board (PCB) received within the receiving cavity;

a plurality of contacts connected to the PCB, the contacts having moveable contacting portions extending through corresponding passageways and upwardly beyond a top face of the top wall; and a magnet including a top section received within the slot, and a bottom section bonded to the bottom wall through hot melting a part of the bottom wall;

wherein the bottom wall has a rib protruding upwardly from an inner face thereof before the magnet is bonded to the bottom wall, the rib being melted to bond the magnet and the bottom wall when the magnet is bonded to the bottom wall;

wherein the bottom wall forms two slits along two lateral sides of the rib to receive a part of the melted rib.

6. The connector assembly as recited in claim 5, wherein a seam bisects the insulative housing along the vertical direction and the insulative housing includes a lower case and an upper case jointed integrally through hot melting.

7. The connector assembly as recited in claim 5, wherein a plurality of guiding protrusions extend downwardly from the top wall to guide the magnet.

8. The connector assembly as recited in claim 7, wherein the magnet is installed to a room defined by the protrusions and retained to the protrusions in an interference-fit manner.

9. The connector assembly as recited in claim 5, wherein the rib includes a strip portion and a triangular pyramid portion extending upwardly therefrom, the triangular pyramid portion being melted through hot melting when the magnet is bonded to the bottom wall.

10. The connector assembly as recited in claim 9, wherein the contacting portion of the contact is deformed to produce a triangular peak that is biased to protrude to the top wall and is moveable toward the top wall responsive to a force applied to the triangular peak.

11. The connector assembly as recited in claim 10, further comprising a film adhered to a top surface of the magnet and a stage extending away from the film, the stage protruding upwardly from the top face of the wall.

12. The connector assembly as recited in claim 11, wherein the passageways are formed on the stage.

13. An electrical connector assembly comprising:

an insulative housing forming a receiving cavity commonly defined by an upper case and a lower case assembled with each other;

a plurality of passageways and a pair of slots formed in the upper case;

a contact module disposed in the receiving cavity and including a plurality of contacts disposed upon an insulative retainer, each of said contacts including a deflectable contacting portion extending upwardly through the corresponding passageways, respectively, and above a top face of said upper case;

a cable extending outwardly from one side of said housing and including a plurality of wires respectively connected electrically to the corresponding contacts; and a pair of magnets located by two sides of the contact module in said receiving cavity; wherein an interior face of said lower case forms a pair of ribs under the corresponding magnets, respectively, and each of said ribs being equipped with at least one slit aside whereby when after a hot melting process, the rib is deformed to fill the slit to have a bottom face of the magnet intimately attached to the upward interior surface of the lower case.

14. The electrical connector assembly as claimed in claim 13, wherein a film is attached upon the top face of the upper case and covers a top face of each of said magnets.

15. The electrical connector assembly as claimed in claim 14, wherein the top face of the upper case is arranged in an offset manner with a center region where the contact are exposed upwardly, and a periphery region, rearwardly offset from the center region, where the magnets are located and the film is applied.

16. The electrical connector assembly as claimed in claim 15, wherein the film is lower than the top face of the upper case in said center region.

* * * * *